US010411334B2

(12) United States Patent
Lerner

(10) Patent No.: US 10,411,334 B2
(45) **Date of Patent: *Sep. 10, 2019**

(54) METHOD FOR FABRICATING A TRANSPARENT ANTENNA BASED ON HYBRID GRAPHENE/METAL NANOMESH STRUCTURES

(71) Applicant: SPAWAR Systems Center Pacific, San Diego, CA (US)

(72) Inventor: Mitchell B. Lerner, San Diego, CA (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 231 days.

This patent is subject to a terminal disclaimer.

(21) Appl. No.: 15/425,622

(22) Filed: Feb. 6, 2017

(65) Prior Publication Data

US 2018/0226713 A1 Aug. 9, 2018

(51) Int. Cl.
*H01Q 1/36* (2006.01)
*H01Q 1/38* (2006.01)

(52) U.S. Cl.
CPC ..... *H01Q 1/368* (2013.01); *H01Q 1/38* (2013.01)

(58) Field of Classification Search
CPC ..... H01Q 1/368; H01Q 1/38
See application file for complete search history.

(56) References Cited

U.S. PATENT DOCUMENTS

| | | | | |
|---|---|---|---|---|
| 9,899,117 | B2 * | 2/2018 | Ren | H01B 1/02 |
| 10,002,927 | B2 * | 6/2018 | Woo | H01L 29/1606 |
| 2013/0114133 | A1 | 5/2013 | Sarto et al. | |
| 2014/0106684 | A1 * | 4/2014 | Burns | H01Q 1/243 455/78 |
| 2018/0220559 | A1 * | 8/2018 | Lerner | H05K 9/0088 |

FOREIGN PATENT DOCUMENTS

EP 20060730463 12/2007

OTHER PUBLICATIONS

Gomez-Diaz et al., Microwave to THz Properties of Graphene and Potential Antenna Applications, 2012 International Symposium on Antennas and Propagation (ISAP2012), Nagoya, Japan, 2012.
Morfa et al., Transparent metal electrodes from ordered nanosphere arraygs, Applied Physics Letters (2013).
Perruisseau-Carrier, Graphene for Antenna Applications: Opportunities and Challenges from Microwaves to THz, Loughborough Antennas and Propagation Conference, UK, 2012.

(Continued)

*Primary Examiner* — Minh N Trinh
(74) *Attorney, Agent, or Firm* — Naval Information Warfare Center Pacific; Kyle Eppele

(57) ABSTRACT

A transparent antenna is fabricated by combining a metal nanomesh structure and a graphene sheet. The nanomesh structure is formed on a surface, and the graphene sheet is placed over the nanomesh structure. The graphene sheet is adhered to the nanomesh structure to form a graphene nanomesh structure. The graphene nanomesh structure is shaped to form the transparent antenna that efficiently transmits and receives signals in a desired frequency range yet is optically transparent.

9 Claims, 2 Drawing Sheets

(56) References Cited

OTHER PUBLICATIONS

Yun et al., Research of Transparent Films Based on Conductive Graphene Network Fabrics for Electromagnetic Shielding, International Conference on Communications, Circuits, and Systems, 2005, Proceedings.
Hong et al., Electromagnetic interference shielding effectiveness of monolayer graphene, Nanotechnology, 2012.
Qiu et al., Infrared-transparent Films Based on Conductive Graphene Network Fabrics for Electromagnetic Shielding, Carbon, Feb. 2015.

* cited by examiner

METHOD FOR FABRICATING A TRANSPARENT ANTENNA BASED ON HYBRID GRAPHENE/METAL NANOMESH STRUCTURES

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 102748.

FIELD OF THE INVENTION

The present invention pertains generally to antennas. More particularly, the present invention pertains to a transparent antenna based on a hybrid graphene/metal nanomesh structure.

BACKGROUND OF THE INVENTION

With the miniaturization of wireless communication devices over the last decade, smaller antennas have become necessary to provide data connections. On-chip space is at a premium, and removal of the antenna from inside a wireless device would allow more room for transistors. This would improve the processing speed and performance of the wireless device.

In addition, as car navigation systems become more popular, there has been a growing need for an antenna that may be applied to a car window to minimize the space required for the antenna. Such an antenna needs to be transparent enough to provide good visibility for a driver.

Transparent conductors have been proposed that are suitable for multiple antenna applications. Transparent conductive material can receive and transmit signals, while maintaining the optical transparency necessary to be integrated into, for example, a display window of a wireless communication device or a vehicle window. Integrating the transparent conductor on the display window of a wireless device also screens out potential interference from electronic sources inside the device.

Some materials that have been proposed for transparent conductors suitable for antenna applications include nanowire networks, metallic mesh structures, graphene sheets, and nanoparticle-based arrays. None of these materials, alone, are capable of simultaneously optimizing all of the parameters needed to be an efficient transparent antenna. In particular, none of the proposed materials, alone, can simultaneously provide high carrier mobility, high optical transparency, and low sheet resistance, all of which are needed to provide a transparent antenna with optimal efficiency.

Transparent conductive oxides, such as Indium Tin Oxide (ITO) have also been proposed as materials for transparent antennas. However, such materials are rigid and are too brittle for antenna applications that demand robustness.

In view of the above, there is a need for a robust transparent antenna that simultaneously provides high carrier mobility, high optical transparency and low sheet resistance.

SUMMARY OF THE INVENTION

According to an illustrative embodiment, a method is provided for fabricating a transparent antenna. The method includes forming a metal nanomesh structure on a surface and placing a graphene sheet over the nanomesh structure. The graphene sheet is caused to adhere to the nanomesh structure, forming a graphene nanomesh structure. The graphene nanomesh structure is shaped to form the transparent antenna that efficiently transmits and receives signals in a desired frequency range yet is at least adequately optically transparent.

These, as well as other objects, features and benefits will now become clear from a review of the following detailed description, the illustrative embodiments, and the accompanying drawings.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
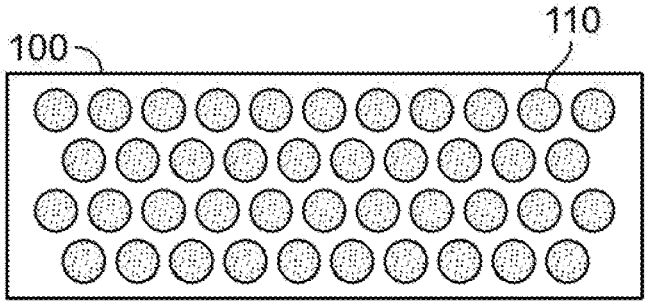
FIG. 1 illustrates a first stage in a process for fabricating a hybrid graphene/mesh transparent antenna.

According to illustrative aspects, a transparent antenna is provided that is a hybrid device including a metallic nanomesh and a graphene sheet.

The metal nanomesh has a low resistance and good electrical conductivity. Graphene also has high carrier mobility, resulting in low sheet resistance and good electrical conductivity.

Those skilled in the art will appreciate that electrical conductors, such as the graphene/nanomesh structure described herein, can act both as an electromagnetic shield and an antenna, depending on the shape of the structure. That is, the dimensions or shape of an electrical conductor determines the wavelengths of signals that will be repelled or absorbed. As the wavelength of a signal varies inversely with the frequency, the shape of an electrical conductor dictates the frequencies at which the structure acts as a shield and the frequency/frequency range at which the structure acts as an antenna.

The metal nanomesh also can be configured to provide at least an adequate amount of optical transparency. The graphene is optically transparent and allows visible light to pass through.

Integrating the metal nanomesh with the graphene, as described herein, results in a hybrid structure that may be expected to perform better as a transparent antenna at a given frequency/frequency range than either the nanomesh material or the graphene material, alone.

Referring now to the drawings, FIGS. 1-4 illustrate stages in a process for fabricating a hybrid graphene/mesh transparent antenna according to an illustrative embodiment. In the embodiment shown in and discussed with respect to FIG. 1, a copper mesh may be fabricated by nanosphere lithography. It should be appreciated that other methodologies may be used to fabricate the copper mesh, such as e-beam lithography or photolithography. Nanosphere lithography is described here for ease of description and illustration. Further, it should be appreciated that other metals may be used for the nanomesh, and copper is described herein only be way of example.

As shown in FIG. 1, polystyrene (PS) microspheres 110 are assembled on, e.g., a glass surface 100. In preparation for assembly on the glass surface 100, the PS microspheres 110 may be put into an ethanol and water mixture. In this solution, the PS microspheres 110 self-assemble into hexagonal domains at the ethanol/water interface, due to different surface tensions. The hexagonally arranged spheres 110 may be transferred onto the glass surface 100, without disturbing their order. The PS spheres 110 may then be etched in oxygen plasma to control the relative spacing between the PS spheres. Lower etching times result in larger inter-sphere spacing with less area covered by the microspheres 110.

Figure 2:
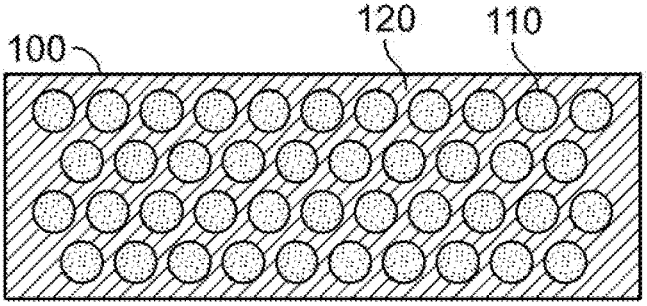
FIG. 2 illustrates a second stage in a process for fabricating a hybrid graphene/mesh transparent antenna.

FIG. 2 shows the next stage in a process for fabricating a hybrid graphene/mesh transparent antenna in which a layer of copper (or other metal) 120 is deposited over the PS microspheres 110 on the glass surface 100. The microspheres 110 act as a protective layer so that copper 120 is only deposited on the glass surface 100 in between the microspheres 110, forming a nanomesh structure. Spacing between portions of the copper nanomesh may be controlled such that a sufficient amount of electrical conductivity is achieved for receiving and transmitting signals at a desired frequency/frequency range and such that an adequate amount of transparency is provided. The spacing may be controlled by adjusting the etching times of the PS microspheres 110.

Figure 3:
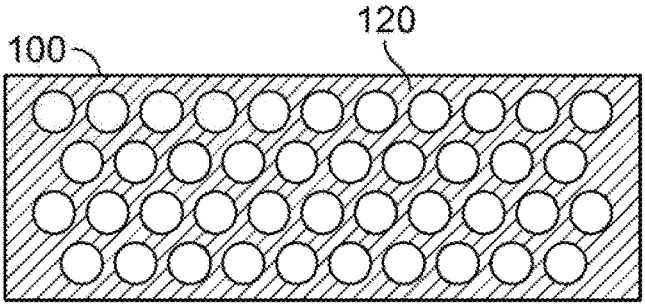
FIG. 3 illustrates a third stage in a process for fabricating a hybrid graphene/mesh transparent antenna.

FIG. 3 shows the next stage in a process for fabricating a hybrid graphene/mesh transparent antenna in which the PS microspheres 110 are removed, e.g., by sonicating in toluene. This leaves only the patterned copper nanomesh 120 on the glass surface 100.

Figure 4:
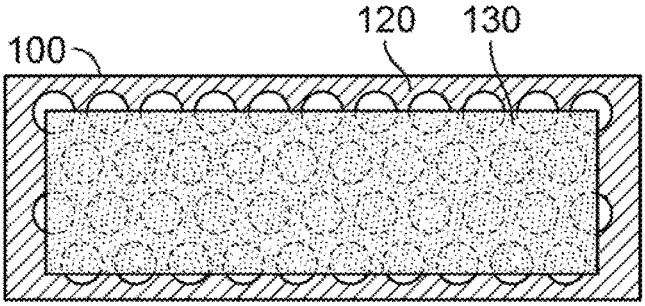
FIG. 4 illustrates a fourth stage in a process for fabricating a hybrid graphene/mesh transparent antenna.

FIG. 4 shows a fourth stage in a process for fabricating a hybrid graphene/mesh transparent antenna in which a sheet of graphene 130 is placed on the copper nanomesh 120. The graphene may be supported by a polymethyl methacrylate (PMMA) layer and may be grown as described in more detail below. A hot plate bake may be used to promote adhesion between the graphene 130 and the nanomesh 120. The resulting graphene/nanomesh structure is shown in FIG. 4.

According to an illustrative embodiment, one or more of the structures shown in FIG. 4 may be shaped to transmit/receive signals in a particular frequency range while effectively shielding signals outside that frequency range. For example, one of the graphene/nanomesh structures or an array of the graphene/nanomesh structures may be etched to form a "circle" antenna that is capable of receiving/transmitting signals in a frequency range around 900 MHz (the emergency broadcast frequency) when connected to a radio transceiver while shielding out signals that are not near the 900 MHz frequency. As another example, one or more of the graphene/nanomesh structures may be shaped to form a "butterfly" antenna that is capable of receiving/transmitting signals around 1200 MHz or 1500 MHz (GPS frequencies) when connected to a radio transceiver while shielding out signals that are not near the 1200 MHz or 1500 MHz range.

According to illustrative embodiments, by modifying the shape of the graphene/nanomesh structure, the structure can be 'tuned" to transmit/receive signals in a desired frequency range while shielding out signals that are outside of that frequency range. The graphene/nanomesh structure may be shaped by at least one of photolithography, e-beam lithography, and shadow-masking to provide a desired dimension for a particular shielding application.

Although not illustrated or described in detail, it should be appreciated that the graphene sheet may be grown by any suitable method, e.g., chemical vapor deposition on copper foil, mechanical exfoliation, epitaxial growth, or chemical synthesis.

For ease of explanation, growth of a graphene sheet by chemical vapor deposition on copper foil is described herein. The graphene is grown at high temperatures, e.g., approximately 1050 degrees Celsius. The graphene may be coated with a PMMA layer to provide support.

The graphene can be removed from the copper foil by bubble transfer or chemical etching. In the case of bubble transfer, the graphene layer, supported by a PMMA layer, is electrochemically separated from the copper by applying a voltage between the copper sheet and a bath containing NaOH. Bubbles form at the electrodes, lifting off the graphene/PMMA stack. Similarly, the PMMA/graphene/copper could be placed in an etchant, such as iron chloride or ammonium persulfate to etch away the copper, thus leaving the PMMA/graphene layers. When the PMMA/graphene is separated from the copper foil, the graphene/PMMA stack can be transferred to the copper nanomesh, as shown in FIG. 4.

Once the graphene is adhered to the metal nanomesh, fabrication is complete. One or more fabricated hybrid metal nanomesh-graphene antennas, such as that shown in FIG. 4, may be used in any situation that requires an antenna but has limited on-chip space. For example, such antennas may be integrated into a display screen of a small mobile platform, such as a wireless communication device, to receive and transmit radio frequency signals. Such antennas could also be integrated into windows of vehicles, such as cars and trucks, to receive and transmit radio signals. The graphene/mesh material could be applied or adhered to a display screen or window using any suitable adhesive. After the graphene/mesh antenna is applied to the display screen or window and connected to a radio transceiver, electrical transmission/reception of radio signals would be enabled.

Figure 5:
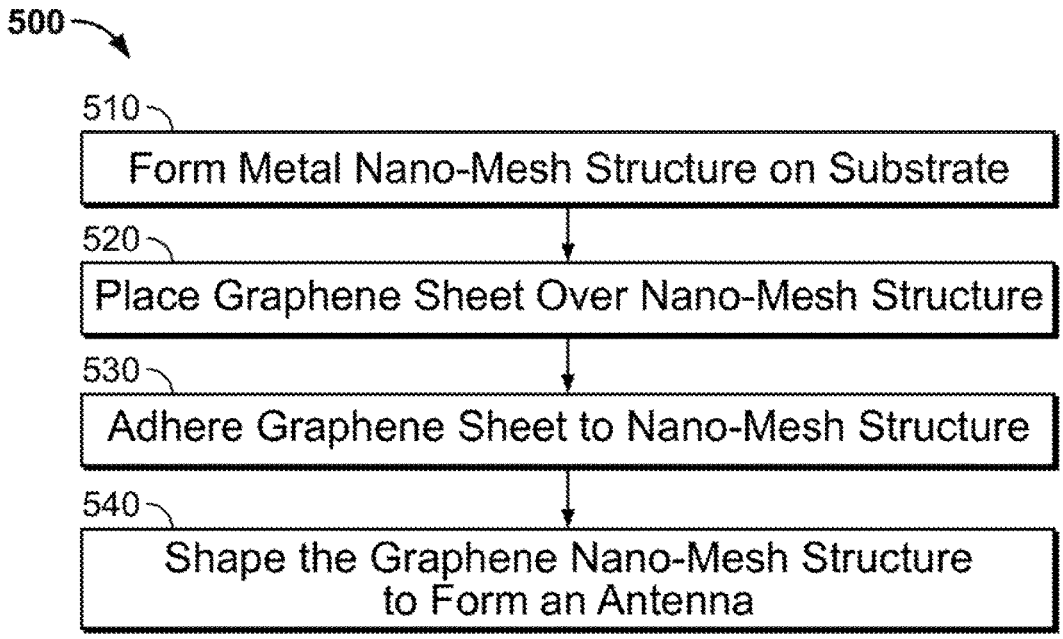
FIG. 5 is a flow chart illustrating the steps involved in a process for fabricating a hybrid graphene/mesh transparent antenna according to several embodiments.

FIG. 5 is a flow chart illustrating the steps involved in a process 500 for fabricating a hybrid graphene metal nanomesh transparent antenna according to illustrative embodiments. It should be appreciated that the steps and order of steps described and illustrated are provided as examples. Fewer, additional, or alternative steps may also be involve in the fabrication of the shield, and/or some steps may occur in a different order.

Referring to FIG. 5, the process for fabricating a hybrid mesh-graphene transparent antenna begins at step 510 at which a metal nanomesh structure is formed on a substrate, such as glass. The metal nanomesh is configured to provide adequate electrical conductivity to transmit and receive signals within a desired frequency range while providing at least adequate optical transparency. At step 520, a graphene sheet is placed on the nanomesh structure. The graphene sheet is also configured to provide adequate electrical conductivity to transmit and receive signals within the desired frequency range and thus increases the transceiver efficiency of the antenna while maintaining the optical transparency.

The metal nanomesh may be formed using any of the techniques described above. The spacing between the portions of nanomesh structure may be selected to provide a desired or at least an adequate amount of electrical conductivity for receiving and transmitting signals in a desired frequency range, considered in conjunction with the electrical conductivity provided by the graphene sheet. The spacing may also be selected to provide a desired or at least an adequate amount of optical transparency which is maintained by the graphene sheet.

At step 530, the graphene sheet is adhered to nanomesh structure using, e.g., a hot bake, resulting in a graphene nanomesh structure. At step 540, the graphene nanomesh structure is shaped to form a transparent antenna that has a desired geometry for transmitting and receiving signals in the desired frequency range.

The hybrid metal nanomesh/graphene structure described above provides efficient reception/transmission of signals in a particular frequency range and also provides optical transparency. The metal nanomesh and the graphene are both good electrical conductors that together act to transmit/receive signals in a particular frequency range, depending on the geometry or shape of the metal nanomesh/graphene structure. Signals outside of the frequency range for which the antenna is designed are shielded out. While the nanomesh provides some transparency, visible light is impeded from passing through the mesh structure. By making the spacing in the mesh structure wider but maintaining enough mesh and appropriate spacing for sufficient electrical conductivity for reception/transmission of signals in a desired frequency range, more visible light is allowed to come through. The spacing between the portions of the metal mesh may be selected so that the transparency is at least adequate.

Combining the graphene sheet with the metal mesh ensures that adequate electrical conductivity is provided for transmission/reception of signals in a desired frequency range yet also maintains the optical transparency, allowing a high percentage of the visible light to pass through. Such a design is expected to provide, for example, optical transparency that is greater than 85%, low sheet resistance (less than 5 ohms/square) and high carrier mobility (greater than 1000 centimeters squared per Volt-second ($cm^2/V*s$) for graphene). There are no known materials that could match the performance of this hybrid structure. As such, the antenna according to illustrative embodiments provides unparalleled efficiency for transmitting/receiving signals in the frequency range for which the antenna is designed. In addition, the antenna according to illustrative embodiments alleviates the need to include an antenna on the same chip as transistors in a device, such as a wireless communication device. This improves the processing speed and performance of the wireless device.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Various embodiments of this invention are described herein. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for fabricating a transparent antenna, comprising:

forming a metal nanomesh structure on a surface;

placing a graphene sheet over the nanomesh structure;

causing the graphene sheet to adhere to the nanomesh structure, forming a graphene nanomesh structure; and shaping the graphene nanomesh structure to form the transparent antenna that transmits and receives signals in a desired frequency range yet is optically transparent.

2. The method of claim 1, wherein the metal nanomesh structure is formed by a nanosphere lithography process.

3. The method of claim 2, wherein the nanosphere lithography process includes depositing a layer of metal over polystyrene microspheres assembled on the surface and removing the polystyrene microspheres from the surface.

4. The method of claim 3, further comprising etching the assembled polystyrene microspheres, such that there are desired spaces between the microspheres assembled on the surface, and the metal is deposited only onto the desired spaces between the microspheres assembled on the surface.

5. The method of claim 1, wherein the metal nanomesh structure is formed using at least one of e-beam lithography and photolithography.

6. The method of claim 1, wherein the graphene sheet is grown by chemical vapor deposition on copper foil.

7. The method of claim 6, wherein the graphene sheet is removed from the copper foil by at least one of chemical etching and bubble transfer.

8. The method of claim 1, wherein the graphene sheet is grown by at least one of mechanical exfoliation, epitaxial growth and chemical synthesis.

9. The method of claim 1, wherein shaping the transparent antenna is performed by at least one of photolithography, e-beam lithography, and shadow-masking to provide a desired geometry for the antenna for transmitting and receiving signals in the desired frequency range.

* * * * *